US006957165B2

(12) United States Patent
Gislason

(10) Patent No.: US 6,957,165 B2
(45) Date of Patent: Oct. 18, 2005

(54) METHOD FOR MEASURING A SHAPE OF A FOOT

(75) Inventor: Kolbeinn Gislason, Kopavogur (IS)

(73) Assignee: Bonus Ortho System A Islandi HF., Reykjavik (IS)

( * ) Notice: Subject to any disclaimer, the term of this patent is extended or adjusted under 35 U.S.C. 154(b) by 89 days.

(21) Appl. No.: 10/451,060

(22) PCT Filed: Dec. 19, 2001

(86) PCT No.: PCT/IS01/00023

§ 371 (c)(1),
(2), (4) Date: Aug. 28, 2003

(87) PCT Pub. No.: WO02/49473

PCT Pub. Date: Jun. 27, 2002

(65) Prior Publication Data

US 2004/0074112 A1 Apr. 22, 2004

(30) Foreign Application Priority Data

Dec. 21, 2000 (IS) ..... 5785

(51) Int. Cl.[7] ..... G06F 15/00

(52) U.S. Cl. ..... 702/155; 12/133 R; 33/6; 36/87; 36/97; 264/40.1; 702/168

(58) Field of Search ..... 702/150, 152, 702/85, 166–168, 170, 179, 187; 12/133 R; 36/8.4, 97, 87; 264/40.1; 425/403; 33/6; 356/376, 613

(56) References Cited

U.S. PATENT DOCUMENTS

| | | | | |
|---|---|---|---|---|
| 1,587,496 | A | 6/1926 | Altieri | 12/133 R |
| 1,777,747 | A | 10/1930 | De Witt | 36/8.4 |
| 5,746,952 | A | 5/1998 | Marshall | 264/40.1 |
| 5,879,725 | A | 3/1999 | Potter | 425/403 |

FOREIGN PATENT DOCUMENTS

| | | |
|---|---|---|
| DE | 199 22 151 A1 | 11/2000 |
| EP | 0 044 611 A1 | 1/1982 |
| GB | 189288 | 11/1922 |

*Primary Examiner*—Bryan Bui
*Assistant Examiner*—John Le
(74) *Attorney, Agent, or Firm*—Birch, Stewart, Kolasch & Birch, LLP

(57) ABSTRACT

The present invention relates to a method for measuring the shape of a foot by means of comparing the shape of the foot with the shape of the reference foot. This is done by fitting a reference shoe to the foot, locating the area wherein the foot and the reference shoe do not coincide, selecting appropriate filler units for the located area and attaching the filler unit to a corresponding area of a shoe last and reforming the shape of the reference shoe by fitting the reference shoe to the shoe last. This is repeated until the reference shoe and the foot fit together.

10 Claims, 6 Drawing Sheets

METHOD FOR MEASURING A SHAPE OF A FOOT

This application is the national phase under 35 U.S.C. § 371 of PCT International Application No. PCT/IS01/00023 which has an International filing date of Dec. 19, 2001, which designated the United States of America.

FIELD OF THE INVENTION

The present invention relates to a method to measure the shape of a foot by means of comparing the foot with a reference foot and by means of selecting out a reference area where there is a deviation from the foot and the reference foot. The outcome of this is a much more inexpensive and faster way to built orthopaedic shoes.

DESCRIPTION OF THE PRIOR ART

One way to measure a foot is by means of electro-optical scanner, which is capable of accurately determining the foot sizing data. From the data a precise foot wear last can be made by using computer automated design mechanism.

A simpler method to make an orthopaedic shoe is by means of a footwear system wherein a sample shoe is tried on by a wearer and the one providing the best fit is chosen. Thereafter, a stock shoe is re-formed with a moulding apparatus to provide a shoe last which is a copy of the stock shoe. The shoe last is what a shoemaker needs to make an orthopaedic shoe.

What characterises these methods is how time consuming the process is from the fitting to the making of the shoes and how expensive it is. Furthermore, there is a difference between the foot when the person is walking and the foot when the persons is standing still. The scanning method can have the disadvantage that this difference is not taken into account when the orthopaedic shoe is made.

The problem in relation to the present invention differs from the above mentioned inventions that it is a time saving method. A reference shoe can be produced in about 20–30 seconds compared to 15 minutes using current state of the art methods, which involve a vacuum presser and 2–3 plastic sheets. Furthermore, the new plastic shoe costs only a fraction of the cost of the old ones.

GENERAL DESCRIPTION OF THE INVENTION

It is an object of the present invention to provide a method and a system that will allow for a cheaper and faster way to make orthopaedic shoes. Further, the object of the present invention is to present a new way for ordering orthopaedic shoes through a communication channel such as the Internet.

According to the first aspect, the invention relates to a method for measuring the shape of a foot, said method comprising the steps of:

compare the shape of the foot with the shape of a reference foot by:

a) fitting a reference shoe to the foot, b) locating an area wherein the foot and the reference shoe do not coincide, c) selecting a filler unit for the located area and attaching the filler unit to a corresponding area of a shoe last, d) reforming the shape of the reference shoe by fitting the reference shoe to the shoe last.

If the reference shoe does still not fit to the foot the procedure a)–d) are repeated until the reference shoe and the foot fit together. Comparing the shape of the foot with the shape of a reference foot preferably comprises fitting the foot to be measured to a reference shoe of the same size by means of fitting the bare foot to the reference shoe. The reference shoe could be available in at least one width so the most likely width would be chosen before starting the fitting procedure and preferably made of resilient material. One way to locate the area where the reference shoe and the foot do not coincide is to inspect where the colour difference of the skin of the foot due to increased pressure from the reference shoe to the foot changes colour, i.e. returns to white. This calls for transparent material of the reference shoe.

In order to locate the area where changes in the reference shoe have to be made in order to fit it to the foot, is to provide the reference shoe with a measuring system. In one embodiment the measuring system is in the form of longitudinal and latitude line wherein the longitudinal lines are marked with for example numbers and the latitude lines with letters. The areas may therefore be transferred to the shoe last, which would be provided with the same measuring system.

After detecting the area where changes from the reference shoe compared to the foot are needed, appropriate filler unit that corresponds to the deviation between the foot and the reference shoe has to be chosen. Preferably these filler units are provided with different sizes and shapes and may be identified by means of numbers or letters or both, wherein the number of areas within the reference shoe is based on information regarding where deviations from a predetermined reference foot generally occur. The filler units may be made of plaster, plastic or any other kind of material. Besides detecting the deviation from the reference shoe, height differences between two legs may be evened out by integrating an insole which corresponds to the height difference between the legs without changing the thickness of the bottom. This makes the height difference invisible.

After selecting a filler unit/units that are likely to correspond to the deviation between the foot and the reference foot, they are attached to a shoe last, wherein the shoe last is provided with the same measuring system as the reference shoe. This enables the attaching of the filler units at the exact same area as where the deviation between the foot and the reference shoe was detected. The attaching of the filler units to the shoe last may be done by means of trammeling them to the shoe last, wherein the shoe last may be made of plaster, plastic or other material. By putting the shoe last with the filler unit/units into the reference shoe, the reference shoe may be reformed to the shape of the last with the filler units attached to it. Preferably the reforming is accomplished by means of heating the shoe last until the material of the reference shoe reforms. After the reforming of the reference shoe, it is fitted again to the foot and the process be repeated, if further changes are needed. If however the reforming fits to the foot, the information regarding the filler units with the numbering regarding the size and shape and the location could be sent to a shoemaker.

A further object of the invention is a method of making shoes fitted to a specific person, said method comprising:

receiving information regarding:

a seize and width of a reference shoe, a number, type and the coordinate of filler units, a height, shape and the type of the insole, and a shoe type and the material and the colour of the material to be used, wherein based on the received information a orthopaedic shoe is made where information regarding the seize, width, type of insole, number of filler units, type of filler units and the location of the filler units are obtained at the fitting procedure.

The customer may in addition to that choose the type of shoe, the material and the colour by himself. The customer may also receive the information obtained from the fitting and make the order by himself for example through the Internet, wherein the receiver of the information would be provided with the shoe last and the filler units of the same type.

DETAILED DESCRIPTION OF THE INVENTION

A preferred embodiment of the invention will now be described in details with reference to the drawing in which.

Figure 1:
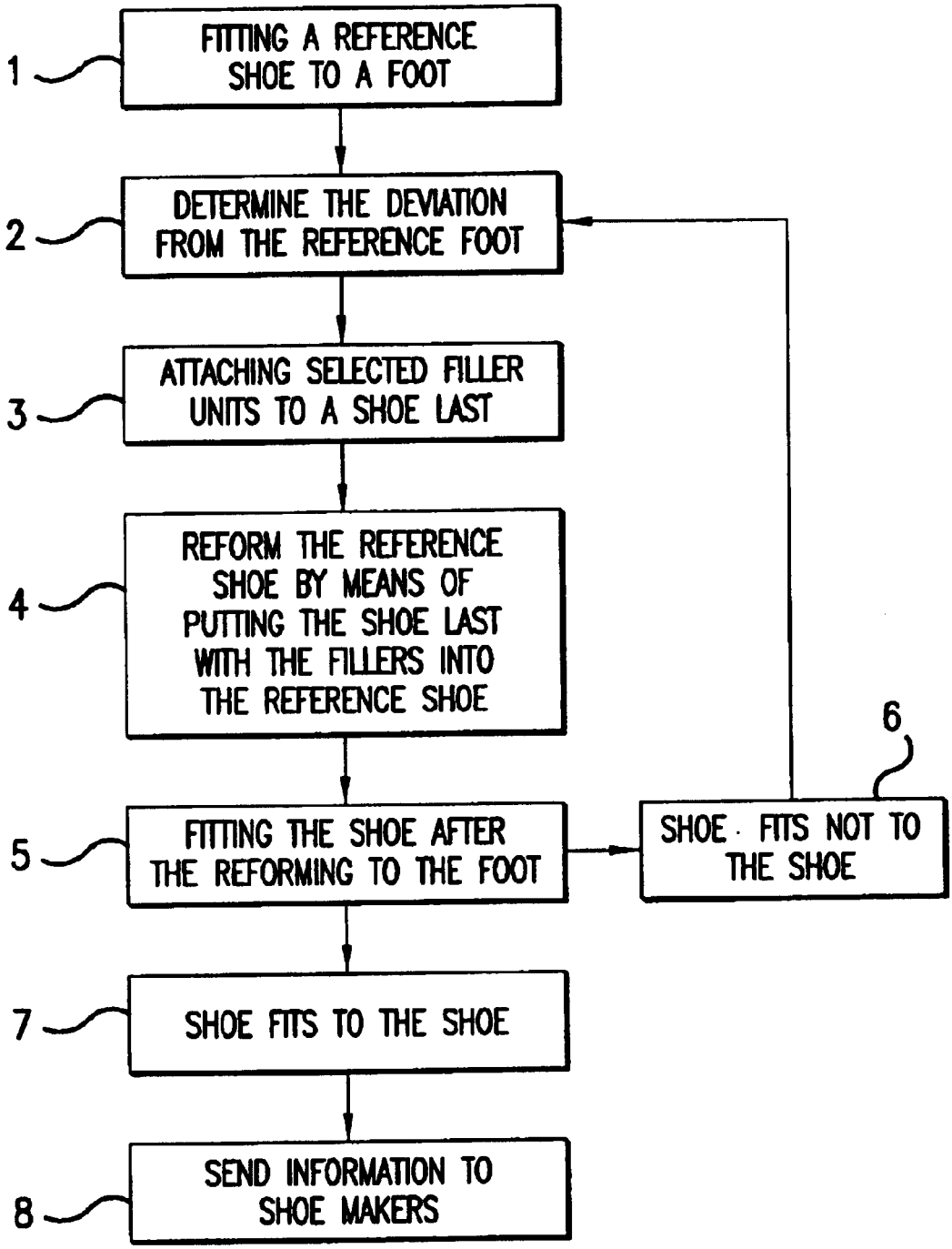
FIG. 1 shows a Layout Diagram of how the invention.
Figure 3:
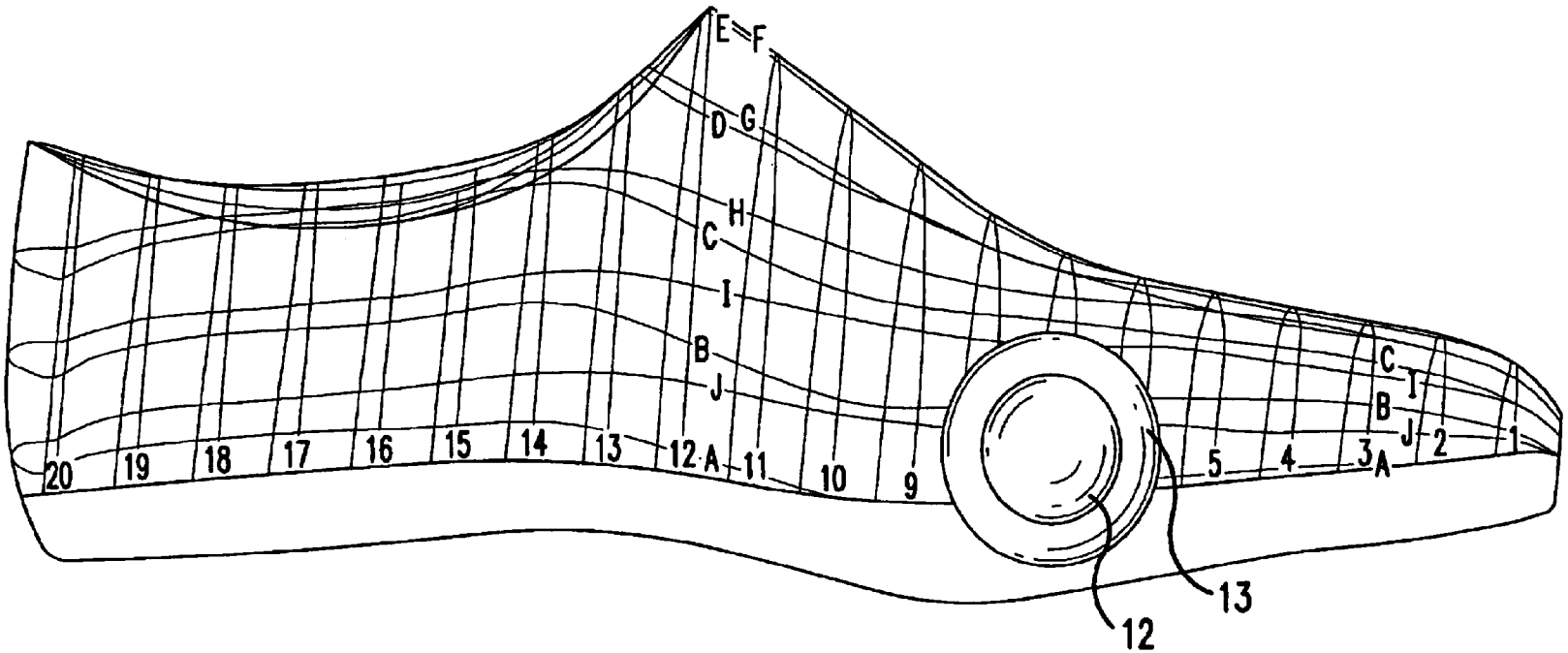
Figure 4:
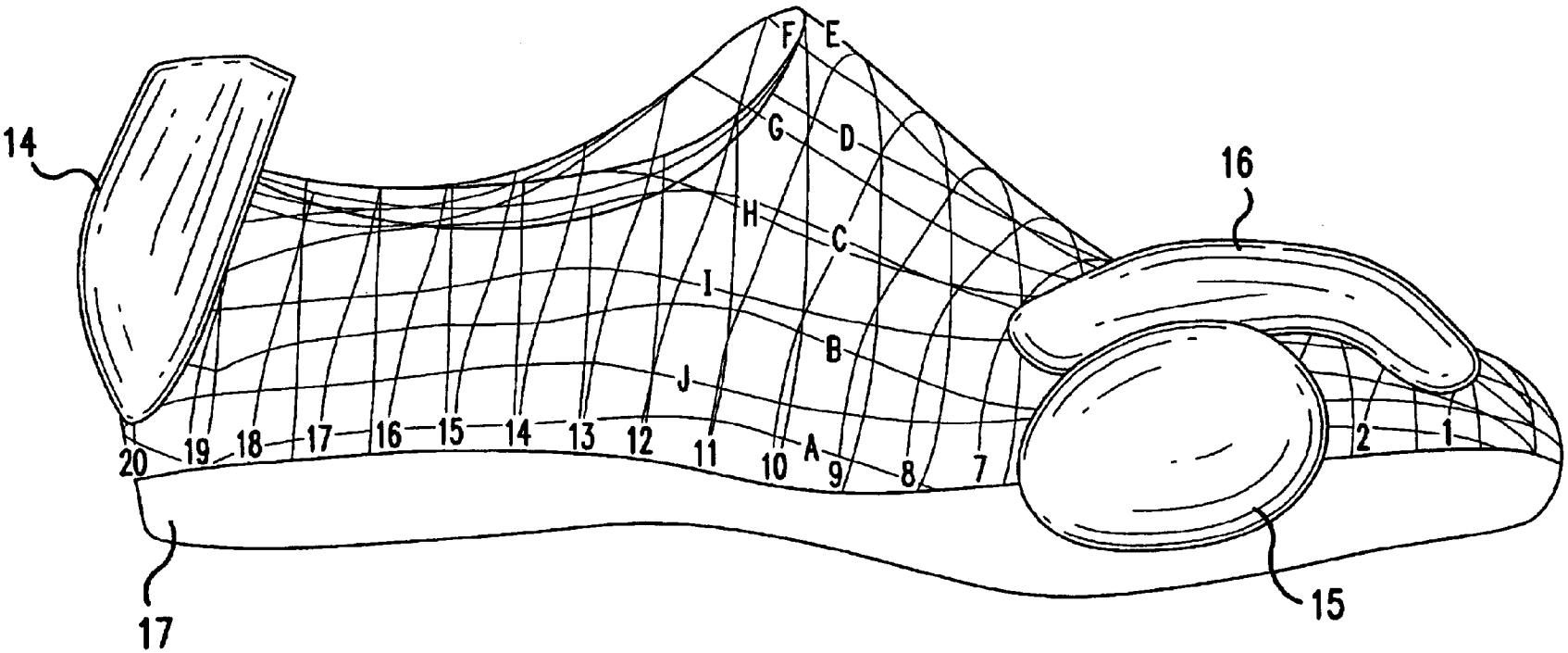
Figure 5:
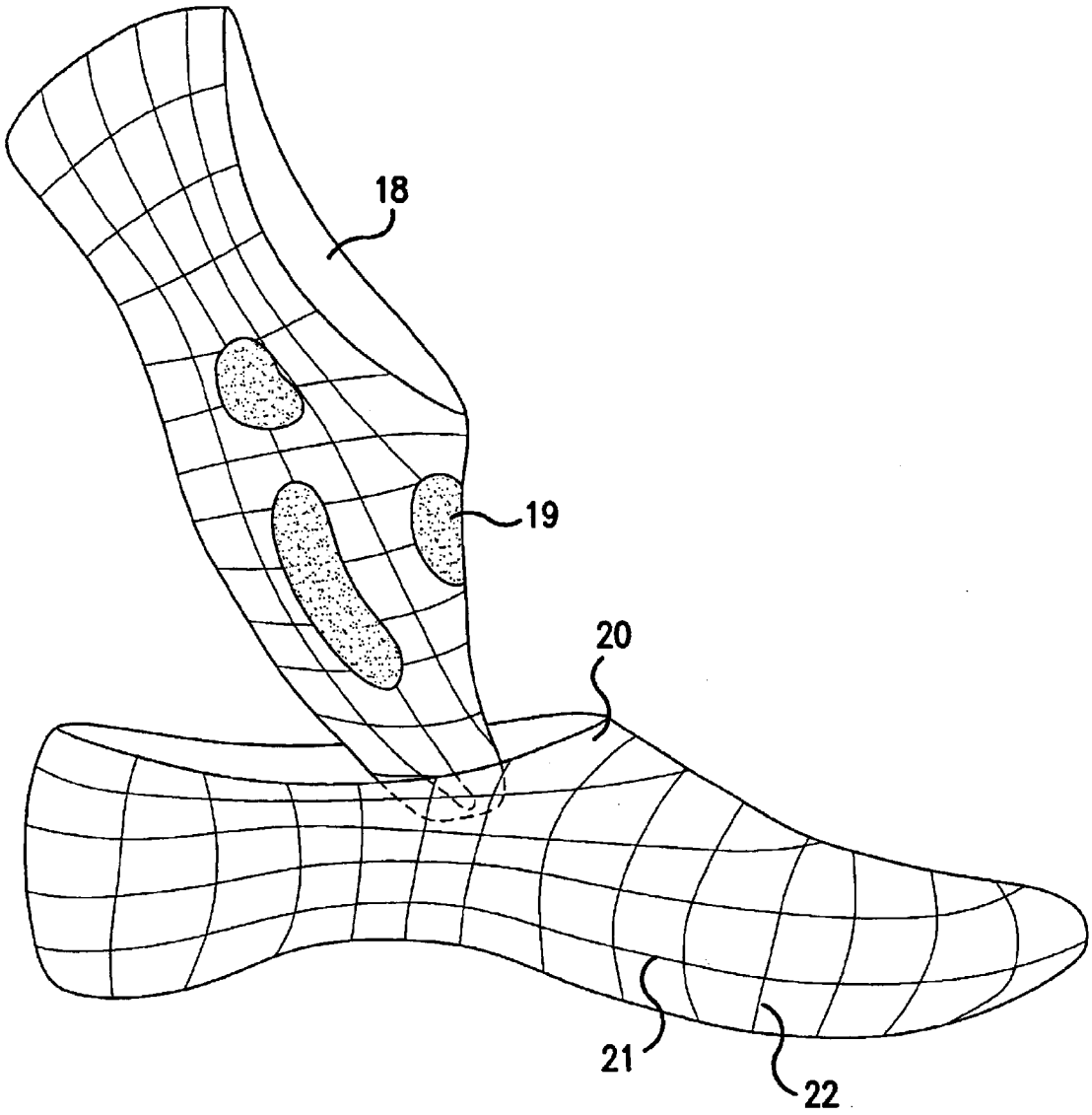
Figure 6:
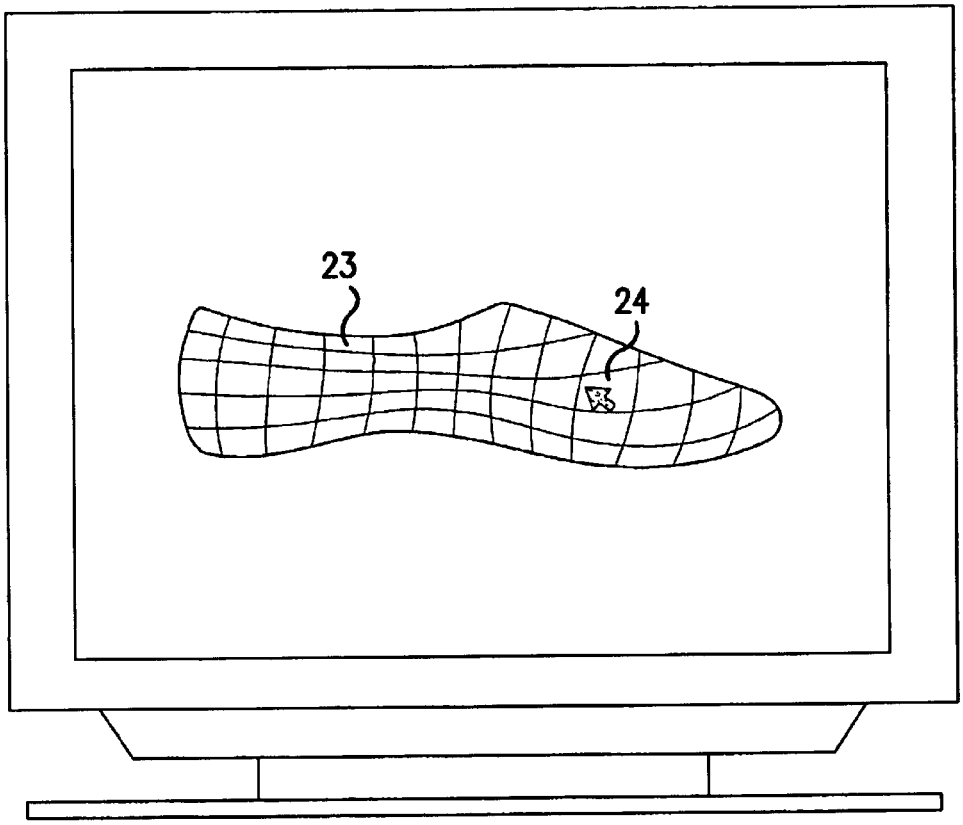

FIG. 3 shows an example of filler units that are used to detect the deviation from the reference foot, FIG. 4 shows where the filler units are attached to a shoe last and wherein a reference shoe of the same size and width as shown in FIG. 1 is reformed in accordance with the filler units, FIG. 5 shows an example of how the reforming is made by beans of fitting the shoe last with filler units to the reference shoe, and FIG. 6 shows an example of how the registration of the filler-unit coordinates on the reference shoe could be made by means of using a computer with a software.

The functionality's of the method in FIG. 1 may be grouped into several parts, whereby the first part is where a reference shoe is fitted to a foot 1 in for example a shoe store, where a sales person fits a reference shoe to the foot of a customer. The fitting could preferably be performed by means of fitting a bare foot to the reference shoe of the same size as the foot. In order to make the fitting more convenient the reference shoe should be made of resilient material such as plastic material. The deviation from the foot 2 from the reference shoe may be located by means of detecting where the foot constricts to the reference foot. This can be achieved by means of detecting where the colour of the barefoot changes when it is both in a rest position and also when it moves. The determination would also be based on where the customer experiences pain. In order to locate where the foot constricts to the reference foot, the reference shoe has to be provided with a measuring system.

After determining where changes on the reference shoe have to be made, appropriate filler units that correspond to the deviation between the foot and the reference shoe have to be chosen 3. This choice can be based on the experience of the sales person. Preferably the filler units are provided with different sizes and shapes and may be identified by means of numbers or letters or both.

After choosing the appropriate filler units, they are attached to a shoe last of the same size and width as the reference shoe and the reforming procedure of the reference shoe begins. One way of attaching the filler units to the shoe last can be done by means of trammeling them to the shoe last, that is if the shoe last is made of material such as plaster or plastic. The shoe last could also be made of metals and therefore the attaching of the filler units would be made in another way such as by means of gluing them to the shoe last or by means of screwing them to the shoe last. In order to attach the filler units to the exact same as in the reference shoe, the shoe last has to be provided with a similar measuring system as the reference shoe. After attaching the filler units to the shoe last, the reforming procedure may be started 4. The reforming may be done by means of moulding, wherein the shoe last with the filler units attached to it is fitted to the reference shoe and then heated until the reference shoe has reformed so the shape of the filler units is added to the shape of the reference shoe. If the shoe last would be made of metal the heating could be controlled by means of heating the shoe last until the reference shoe has been reformed.

After the reforming of the reference shoe the customer tries on the new reformed reference shoe again 5. If the reference shoe is still not properly customised the process from 1–4 has to repeated again 6. If however the reference shoe is customised to the foot of the customer 7, an order can be sent to a shoemaker. The information could comprise the size and the width of the reference shoe and also the number and the type of the filler units with their location on the reference shoe. Furthermore, height differences between to customers legs may be evened out by means of integrating an insole to the shoe with a height that corresponds to the height difference between the legs without changing the thickness of the bottom. This would make the height difference invisible.

Figure 2:
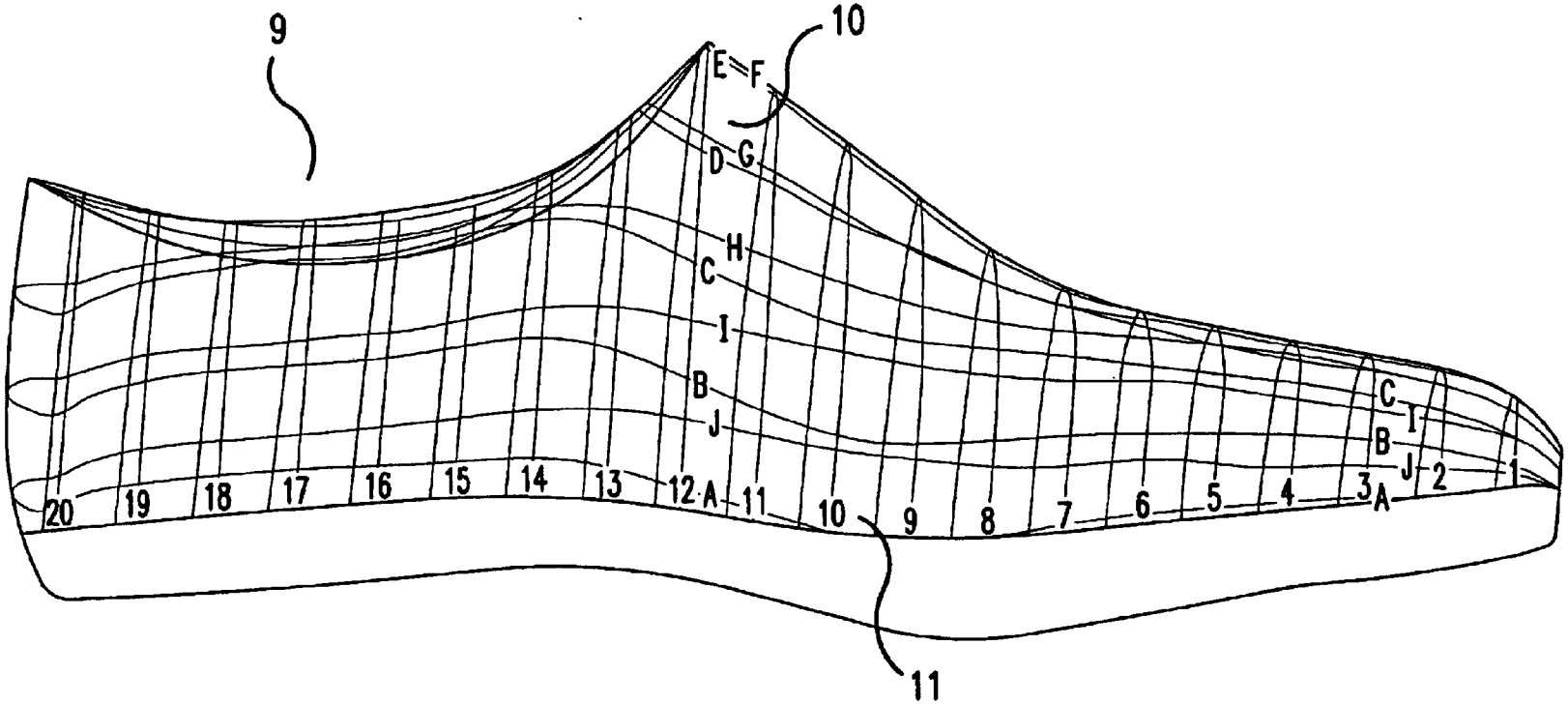
FIG. 2 shows a reference shoe 1 and the measuring system.

FIG. 2 shows the reference shoe 9 with an example of a measuring system, wherein the measuring system is in the form of longitudinal and latitudinal lines and wherein the longitudinal lines are marked with numbers 10 and the latitudinal lines with letters 11. The purpose of such coordinate system is to locate where a reforming from the reference shoe is needed, i.e. to locate the filler units, and to transform the changes that are needed to the shoe last, which should be provided with a similar measuring system. As already mentioned, the material of the reference shoe is preferably made of transparent material. This is in order to be able to visually locate the area where the foot and the reference shoe do no coincide, wherein the location is based on colour differences on the bear foot as mentioned before. Furthermore, the reference shoe should be made of deformable material such as plastic material.

FIG. 3 shows an example of filler units of a different sizes but located within the same reference area, where the smaller one 12 indicates a small deviation from the reference shoe and the larger one 13 larger deviation. Each reference area can be provided with plurality of filler units with a different shape and size.

FIG. 4 shows an example where the filler units 14–16 are attached to a shoe last with the same size and width as the reference shoe. The figure shows also where the height difference between the legs has been integrated by means of using an insole instead of increasing the thickness of the bottom 17.

FIG. 5 shows an example of the reforming procedure wherein the shoe last 18 with the attached filler units 19 is fitted to a reference shoe 20. For an exact registration of the filler-unit-coordinates on the reference shoe, a computer with a software may be used as shown in FIG. 6, wherein the resolution of the coordinate system would be much higher than the one on the reference shoe. By means of showing the exact same shoe on the screen, i.e. the same size and width, the exact coordinates could be chosen by means of approaching the reference area on the computer monitor where the foot and the reference shoe do not coincide as close as possible and select that point. By selecting it, the result could be registered in the computer system with the type of filler unit.

The registration could also be performed by means of registering manually directly from the reference shoe. This is however more inaccurate due to the lower resolution. Example of this is where the reference area of the foot and the reference shoe do not lie between a longitudinal line 5 and a latitudinal line 7. The resolution of the measuring system on the shoe would not be enable an exact location of that point wherein the computer software would provide more exact result.

From the number, type and the coordinates of the filler units along with the shoe type, material of the shoe and the type of bottom that the customer wishes an order may be sent to a shoemaker or shoe factory that even specialises in making orthopaedic shoes. The order could be carried out through a communication channel such as the Internet or by means of faxing the order to the shoe factory. The factory would be provided with similar shoe lasts and filler units, and by means of having this information, orthopaedic shoes in accordance with the customers wishes could be made.

What is claimed is:

1. A method for fitting a shoe to a foot, said method comprising the steps of:

comparing the shape of the foot with the shape of a reference shoe by:

a) fitting a reference shoe to the foot, b) locating an area wherein the foot and the reference shoe do not coincide, c) selecting a filler unit for the located area and attaching the filler unit to a corresponding area of a shoe last, and d) reforming the shape of the reference shoe by fitting the reference shoe to the shoe last, wherein the reference shoe is provided in a transparent material comprising a measuring system for finding the corresponding area of the shoe last, and wherein the area wherein the foot and the reference shoe do not coincide is located by visually inspecting the foot through the reference shoe.

2. A method according to claim 1, wherein the procedure a)–d) is repeated until the reference shoe and the foot fit together.

3. A method according to claim 1, wherein the shoe last is provided with a measuring system corresponding to the measuring system of the reference shoe.

4. A method according to claim 1, wherein the measuring system comprises longitudinal and transversal lines.

5. A method according to claim 1, wherein the reference shoe comprises at least one width for a given size.

6. A method according to claim 1, wherein the filler units within each reference area fillers are provided at least one size.

7. A method according to claim 1, wherein the filler units within each reference area fillers are provided at least one shape.

8. A method according to claim 1, wherein the filler units are marked with numbers and/or digits.

9. A method according to claim 1, wherein the reforming comprises fitting the shoe last with the filler units to the reference shoe and increase the surrounding temperature until the reference shoe reforms in accordance to the filler units.

10. A method according to claim 1, wherein the fitting procedure is repeated if further reforming is needed.

* * * * *